US006990935B2

(12) United States Patent
Simpson

(10) Patent No.: US 6,990,935 B2
(45) Date of Patent: Jan. 31, 2006

(54) PIVOTING LIFTER CONTROL SYSTEM USING SPOOL VALVE AND CHECK VALVE TO RECIRCULATE OIL

(75) Inventor: Roger T. Simpson, Ithaca, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/968,451

(22) Filed: Oct. 19, 2004

(65) Prior Publication Data

US 2005/0109297 A1 May 26, 2005

Related U.S. Application Data

(60) Provisional application No. 60/515,096, filed on Oct. 27, 2003.

(51) Int. Cl.
*F01L 9/02* (2006.01)

(52) U.S. Cl. ..... 123/90.12; 123/90.16; 123/90.15; 123/90.2; 123/90.48; 123/90.52; 123/90.55; 123/90.56; 74/569; 74/54; 74/55

(58) Field of Classification Search ..... 123/90.12, 123/90.16, 90.2, 90.61, 90.63
See application file for complete search history.

(56) References Cited

U.S. PATENT DOCUMENTS

| | | | | |
|---|---|---|---|---|
| 4,869,215 A * | 9/1989 | Parsons | 123/90.16 |
| 5,002,022 A | 3/1991 | Perr | 123/90.12 |
| 5,056,477 A | 10/1991 | Linder et al. | 123/90.17 |
| 5,657,725 A | 8/1997 | Butterfield et al. | 123/90.17 |
| 6,257,183 B1 | 7/2001 | Vorih et al. | 123/90.12 |
| 6,357,406 B1 | 3/2002 | Simpson | 123/90 |
| 6,688,267 B1 * | 2/2004 | Raghavan | 123/90.16 |
| 6,883,474 B2 * | 4/2005 | Bucknor | 123/90.12 |

FOREIGN PATENT DOCUMENTS

| | | |
|---|---|---|
| EP | 0292 185 | 11/1988 |
| JP | 61093216 A | 5/1986 |
| JP | 62126213 A | 6/1987 |
| JP | 62203911 | 9/1987 |

OTHER PUBLICATIONS

Jacobs Vehicle Systems, http://www.jakebrake.com/content.php4?doc uid=11; 2 pages.

* cited by examiner

*Primary Examiner*—Thomas Denion
*Assistant Examiner*—Kyle M. Riddle
(74) *Attorney, Agent, or Firm*—Brown & Michaels, PC; Greg Dziegielewski

(57) ABSTRACT

An internal combustion engine that has a camshaft having a plurality of cam lobes, a plurality of valves where each of the valves are actuated by a lifter actuated by the camshaft with a cam lobe. The lifter comprises a lifter body having an upper surface and a lower surface. A cam contact plate pivots on an axis on the upper surface of the lifter body. Opposed hydraulic actuators are present on either side of the axis of the cam contact plate, where each hydraulic actuators comprise a fluid chamber in the lifter body, a piston in the chamber, and a spring biasing the piston into contact with the cam contact plate. The lifter further comprises a line supplying hydraulic fluid to the fluid chambers of the hydraulic actuators and a control valve for controlling fluid flow from one hydraulic actuator to the other hydraulic actuator.

8 Claims, 20 Drawing Sheets

PIVOTING LIFTER CONTROL SYSTEM USING SPOOL VALVE AND CHECK VALVE TO RECIRCULATE OIL

REFERENCE TO RELATED APPLICATIONS

This application claims an invention which was disclosed in Provisional Application No. 60/515,096, filed Oct. 27, 2003, entitled "PIVOTING LIFTER CONTROL SYSTEM USING CONTROL VALVE TO RECIRCULATE FLUID." The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of pivoting lifters. More particularly, the invention pertains to a control system for pivoting lifters using valves to recirculate oil.

2. Description of Related Art

Conventionally, variable lift systems require oil pressure from the engine to disengage a pin on the lifter. This added oil requirement means that the oil pump must be upsized for the short periods of time that the lifter is switched. The upsized pump adds to the parasitic loss of the engine and can increase fuel consumption.

Prior art U.S. Pat. No. 6,357,406, hereby incorporated by reference, teaches a method of controlling the oil into and out of two solenoid valves controlling the two sides of the lifter plate.

U.S. Pat. No. 6,257,183 discloses a lost motion valve actuation system where a trigger valve acts as an on/off valve in directing fluid to an accumulator. The accumulator is directly hydraulically connected to the on/off valve as well as passages leading to and from the exhaust and intake tappets. Check valves are placed in the passages between the trigger valves and the tappets, permitting flow from the tappets to the trigger valve. The accumulator comprises a spring biasing means for urging a piston in a direction to decrease the size of the chamber in the accumulator. The accumulator provides surge volume and source of makeup oil and pressure to the lost motion valve actuation system. The lost motion valve actuation system does not allow proportional control of the flow of fluid and fluid is not recirculated through the on/off valve but comes directly out of the accumulator. FIG. 1 shows a graph of valve lift versus crank angle. As shown in the graph the lost motion valve actuation system changes the cam lift profile.

JP61093216A discloses a check valve that feeds oil into the pressure chambers of a tappet, which is forcibly closed by a solenoid valve. The solenoid valve is controlled by a controller in accordance with engine conditions.

JP62126213A provides oil from a remote location to communicate with an oil chamber adjacent to the tappet holder through a check valve.

JP62203911 discloses a solenoid valve that supplies working fluid to a chamber via a check valve during high loaded engine operations. The working fluid form the chamber lifts a control rod against a spring force to set valve timing.

SUMMARY OF THE INVENTION

An internal combustion engine that has a camshaft having a plurality of cam lobes, a plurality of valves where each of the valves are actuated by a lifter actuated by the camshaft with a cam lobe. The lifter comprises a lifter body having an upper surface and a lower surface. A cam contact plate pivots on an axis on the upper surface of the lifter body. Opposed hydraulic actuators are present on either side of the axis of the cam contact plate, where each hydraulic actuators comprise a fluid chamber in the lifter body, a piston in the chamber, and a spring biasing the piston into contact with the cam contact plate. The lifter further comprises a line supplying hydraulic fluid to the fluid chambers of the hydraulic actuators and a control valve for controlling fluid flow from one hydraulic actuator to the other hydraulic actuator.

DETAILED DESCRIPTION OF THE INVENTION

Figure 1:
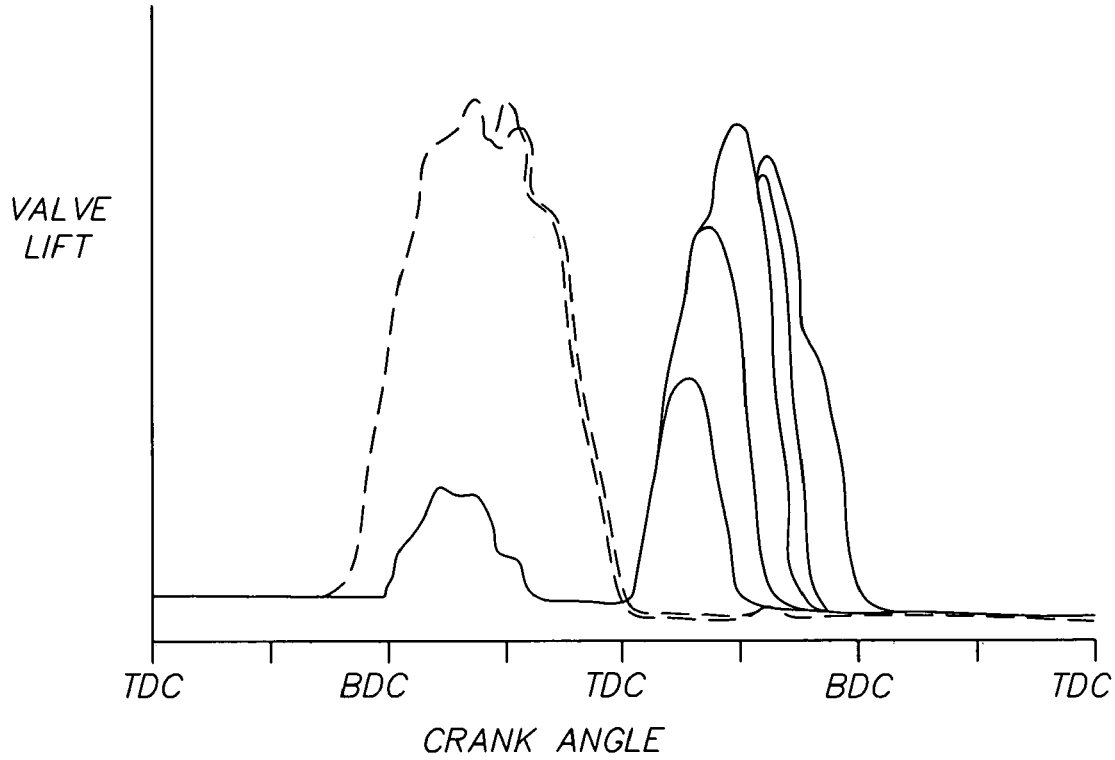
FIG. 1 (PRIOR ART)
FIG. 1 shows a graph of valve lift versus crank angle of prior art U.S. Pat. No. 6,257,183.
Figure 2:
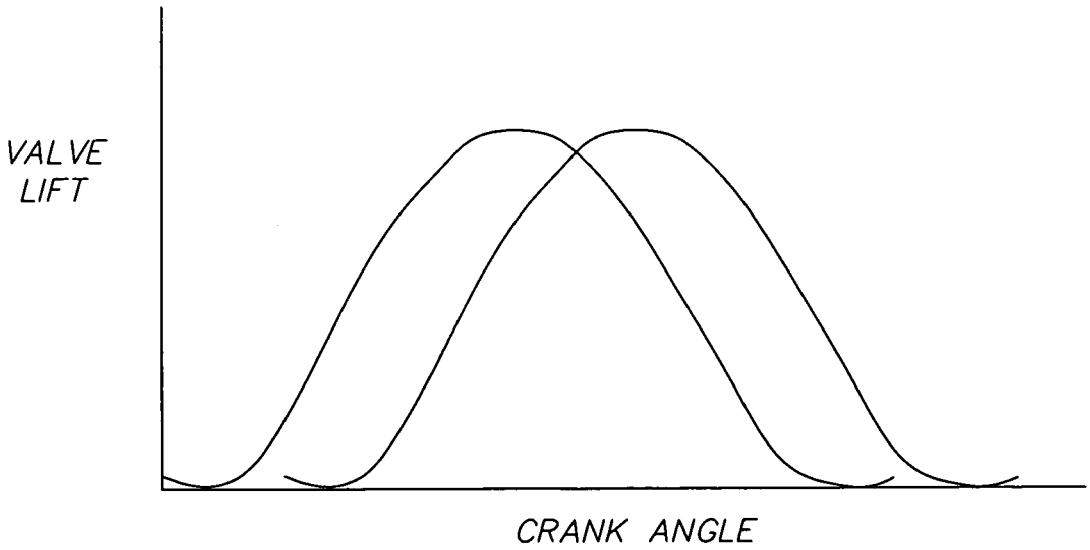
FIG. 2 shows a graph of valve lift versus crank angle of the present invention.

Valve actuation systems or pivoting lifter systems are used in an engine to vary the timing and lift of the intake and exhaust valves of the engine. The present invention uses a system that recirculates hydraulic fluid from one hydraulic actuator to another using the force of the camshaft lobe as it rotates around. FIG. 2 shows a graph of valve lift versus crank angle. As opposed to the prior art, the pivoting lifter system of the present invention does not change the cam lift profile, instead the phase is shifted such that a first cam lift profile overlaps with the next cam lift profile.

Figure 3:
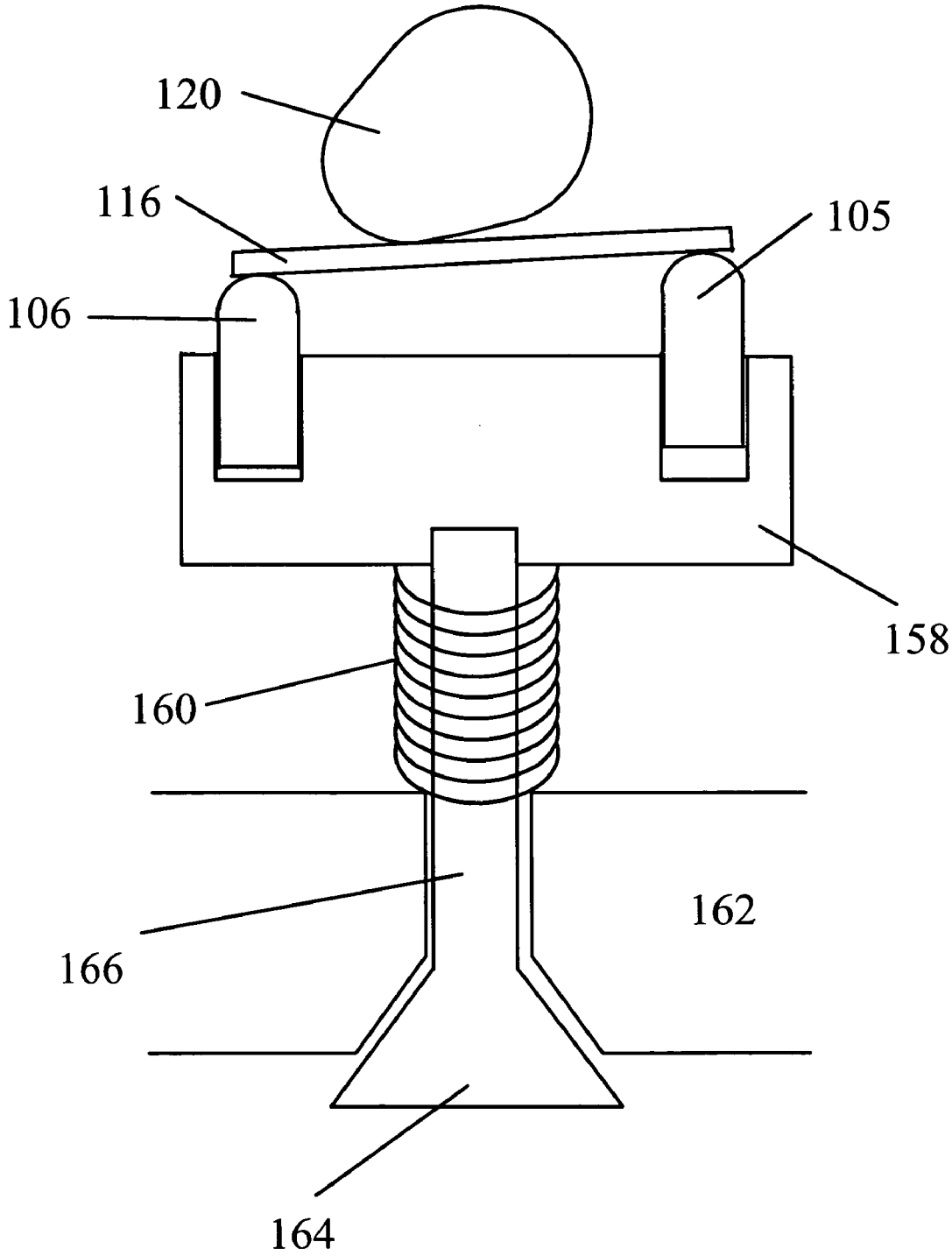
FIG. 3 shows a schematic of the pivoting lifter of the present invention.

FIG. 3 shows an overall schematic of the pivoting lifter in the engine. A valve stem 166 connects valve head 164 to lifter body 158. Spring 160 biases the valve head 164 to come into contact with valve seat 162 of the engine block. Chambers in the lifter body 158 receive hydraulic actuators 105, 106. Hydraulic actuators 105, 106 may be hollow or solid pistons biased by a spring (not shown). The pivoting lifter plate or cam contact plate 116 is in contact with both the hydraulic actuators 105, 106 and cam lobe 120. The position of the both the hydraulic actuators 105, 106 in the chambers of the lifter body 158 is influenced by the position of the cam lobe as it contacts the pivoting lifter plate or cam contact plate 116.

Figure 4:
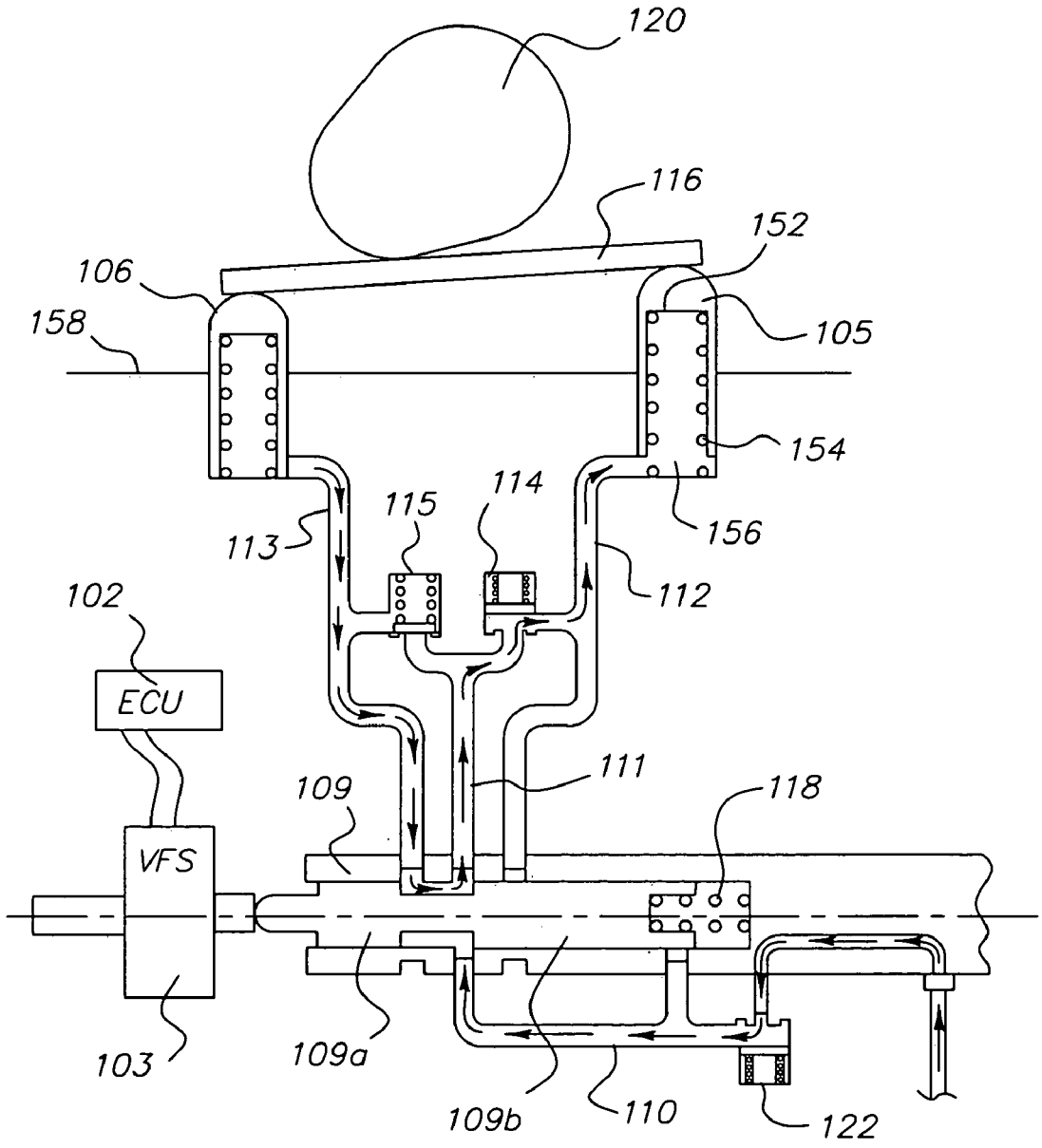
FIG. 4 shows a schematic of the pivoting lifter control system in the first position.
Figure 5:
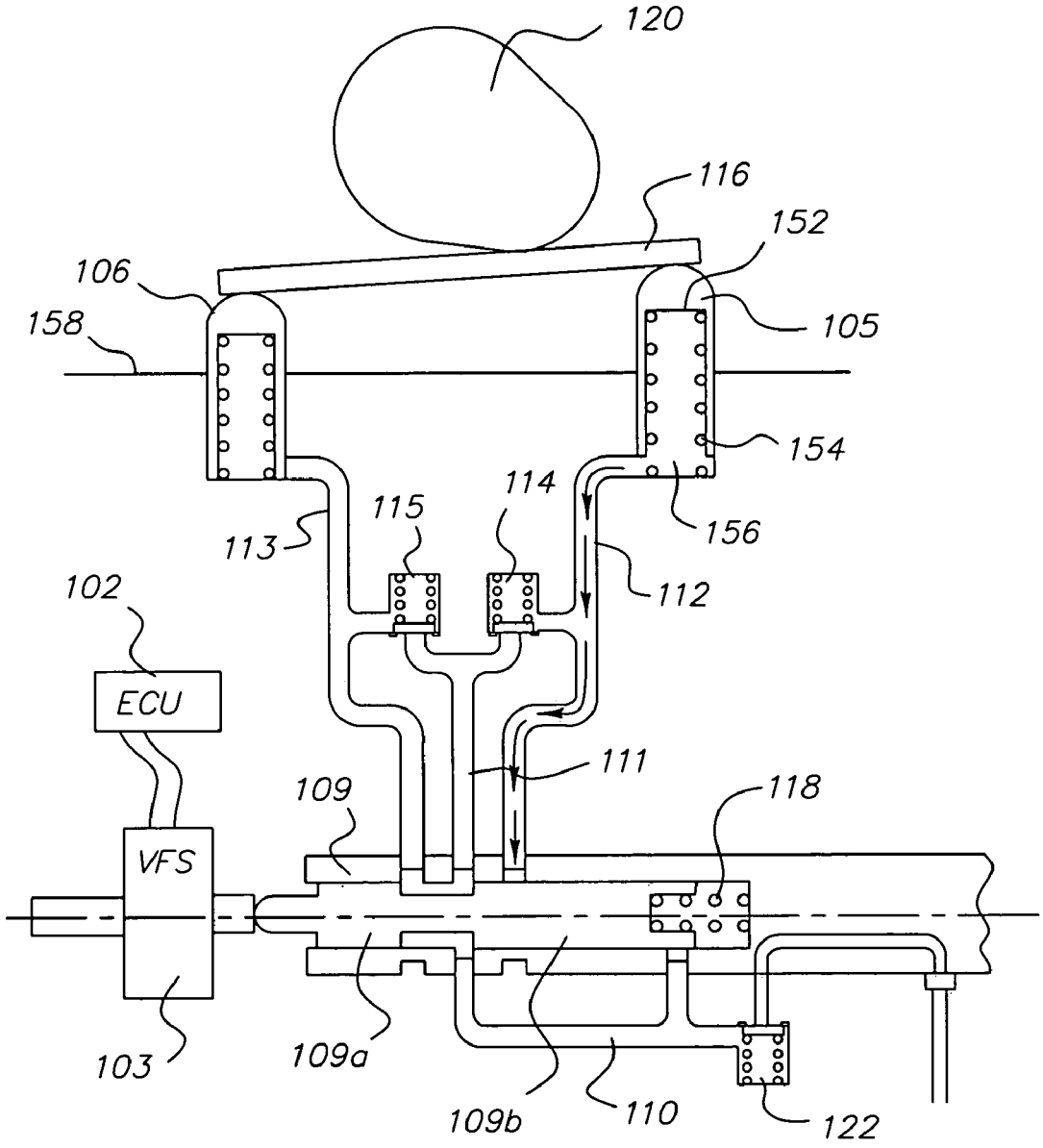
FIG. 5 shows a schematic of the pivoting lifter control system maintaining the first position.
Figure 6:
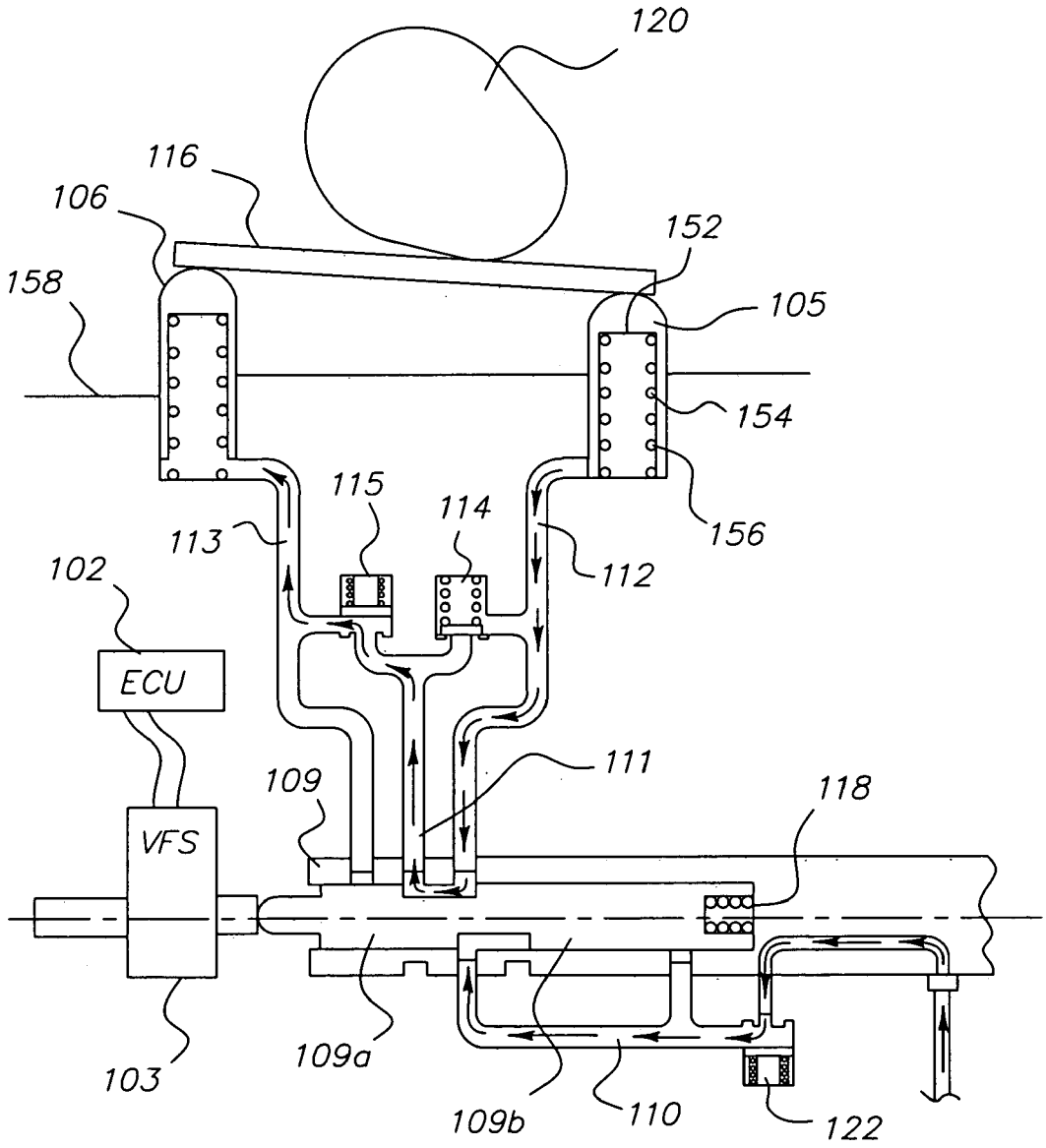
FIG. 6 shows a schematic of the pivoting lifter control system when the spool is moved to a second position.
Figure 7:
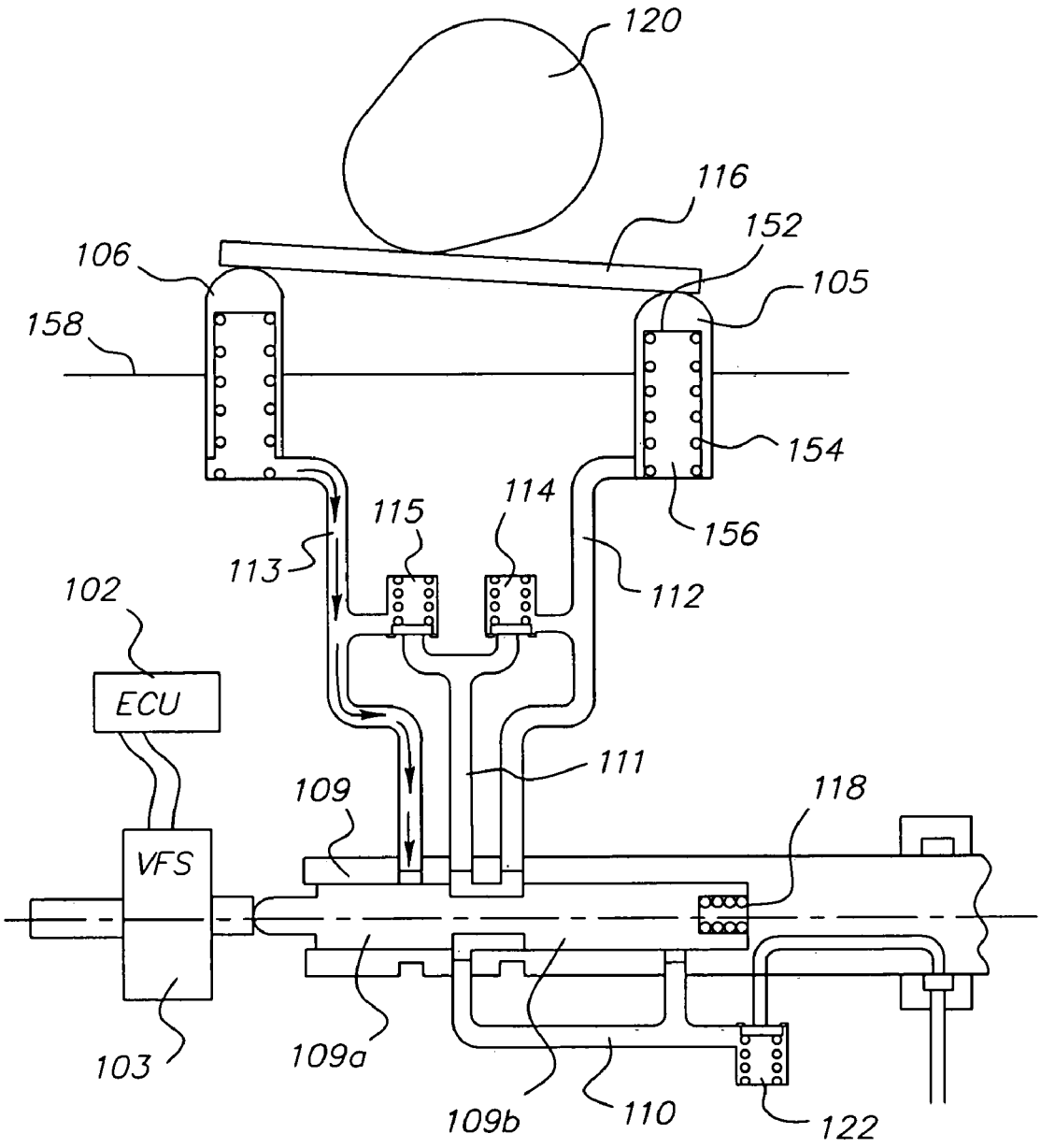
FIG. 7 shows a schematic of the pivoting lifter control system maintaining the second position of the spool.

FIGS. 4 through 7 show the positions of the cam lobe as it rotates and contacts the pivoting lifter plate 116. FIG. 4 shows the cam lobe 120 contacting and pressing down on the pivoting lifter plate 116. FIG. 5 shows the position of the cam lobe 120 after it has rotated counterclockwise and maintenance of the position of the pivoting lifter plate. FIG. 6 shows the cam lobe 120 just prior to lobe rotating counterclockwise again, after the spool position has changed. FIG. 7 shows the cam lobe 120 just after the lobe has rotated counterclockwise and maintenance of the position of the pivoting lifter plate.

FIG. 4 shows a schematic of the pivoting lifter of a first embodiment. Hydraulic fluid or oil is supplied from a source to an inlet line 110, which passes through check valve 122 to control valve 109. The control valve 109 is slidable back and forth and has two lands 109*a* and 109*b* each of which fit snuggly within a bore in the head. The control valve 109 is biased by a spring 118 on one side and a variable force actuator 103, which may be a variable force solenoid on the other. The variable force actuator 103 is controlled by the engine control unit (ECU) 102. The position of the control valve 109, inwards or outwards, determines the flow of oil, to and from each of the hydraulic actuators 105, 106 adjacent to the pivoting lifter plate or cam contacting plate 116 in addition to the force exerted on the lifter plate 116 by the cam lobe 120. In this embodiment, the hydraulic actuators 105, 106 comprise a hollow piston 152, a fluid chamber 156, and a spring 154, though as mentioned previously may comprise a solid piston and a spring.

As shown in FIG. 4, the control valve 109 is in an outward position and hydraulic fluid flows into inlet line 110 through check valve 122 and through control valve 109 to line 111. Line 111 branches into two paths, leading to lines 112, 113, each containing a check valve 114, 115 respectively. The check valves 114, 115 allow fluid into lines 112, 113 only. Each of the paths 112, 113 leads to a hydraulic actuator 105, 106 respectively. Hydraulic fluid enters the fluid chamber 156 of the hydraulic actuator 105 overcoming the force of spring 154 to move the hollow piston 152 up, raising the pivoting lifter plate on the right side, as shown in the Figure. At the same time, the force of the cam lobe 120 pressing down on the pivoting lifter plate 116, compressing spring 154 which causes hydraulic fluid in the hydraulic actuator 106 to exhaust to line 113. Hydraulic fluid from line 113 feeds through control valve 109 into line 111 until mostly all the fluid is exhausted from hydraulic actuator 106. From line 111, fluid enters line 112 and fluid chamber 156 of hydraulic actuator 105 through check valve 114. Once most of the fluid has exhausted from hydraulic actuator 106 and cam lobe 120 begins to rotate, most of the hydraulic fluid has passed through line 111 and check valve 114 closes due to lack of pressure and fluid. Since land 109*b* blocks line 112 from recirculating fluid through the control valve 109 and check valve 114 blocks recirculation of fluid, fluid in the hydraulic actuator 105 remains in place as shown in FIG. 5, until control valve 109 moves again to a retard position.

The control valve 109 is moved inward by the variable force actuator 103 as the cam lobe 120 presses down on the pivoting lifter plate 116. The control valve 109 movement to the retard position and the cam lobe 120 pressure on the pivoting lifter plate 116 and the hydraulic actuator 105, causes the spring 154 to compress and fluid to exhaust from the fluid chamber 156 into line 112. From line 112 fluid enters the control valve 109 and line 111. The fluid and pressure causes check valve 115 to open, allowing fluid into line 113 which leads to hydraulic actuator 106. As the fluid fills chamber 156, spring 154 expands, pushing up on hollow piston 152 and pivoting lifter plate 116, raising the left side of the plate 116. Additional fluid is added to line 111 from inlet line 110 for makeup purposes.

Once most of the fluid has exhausted from hydraulic actuator 105 and cam lobe 120 begins to rotate, most of the hydraulic fluid has passed through line 111 and check valve 115 closes due to lack of pressure and fluid. Since land 109*a* blocks line 113 from recirculating fluid through the control valve 109 and check valve 115 blocks recirculation of fluid, fluid in the hydraulic actuator 106 remains in place as shown in FIG. 7, until control valve 109 moves again.

Figure 8:
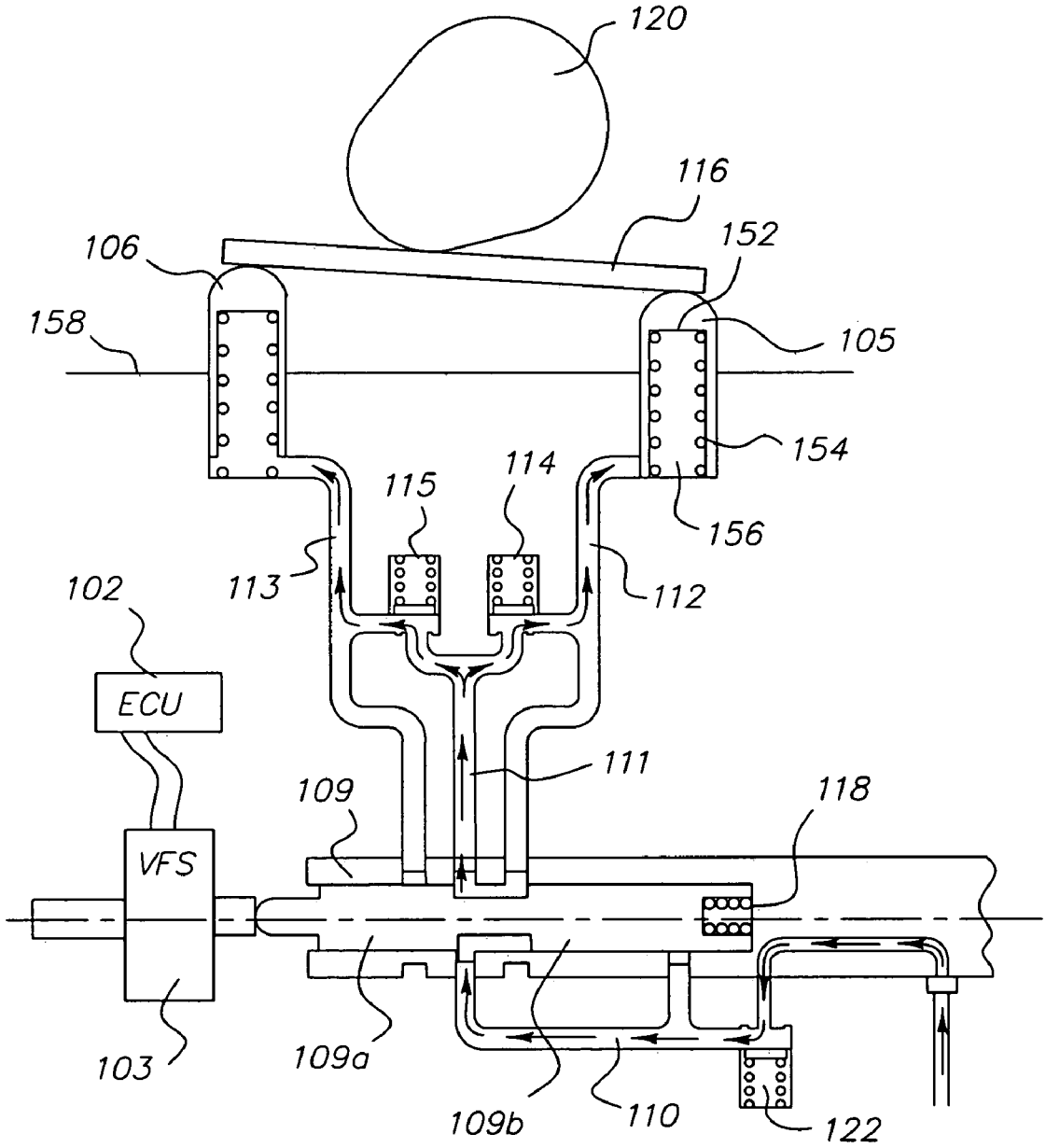
FIG. 8 shows a schematic of the pivoting lifter system when make-up oil is supplied.

Makeup fluid is provided as shown in FIG. 8, when the control valve 109 is a null position. Hydraulic fluid from inlet line 110 flows through check valve 122 and control valve 109 into line 111. From line 111, fluid flows through check valves 114, 115 to lines 112, 113 and into hydraulic actuators 105, 106 respectively.

Figure 9:
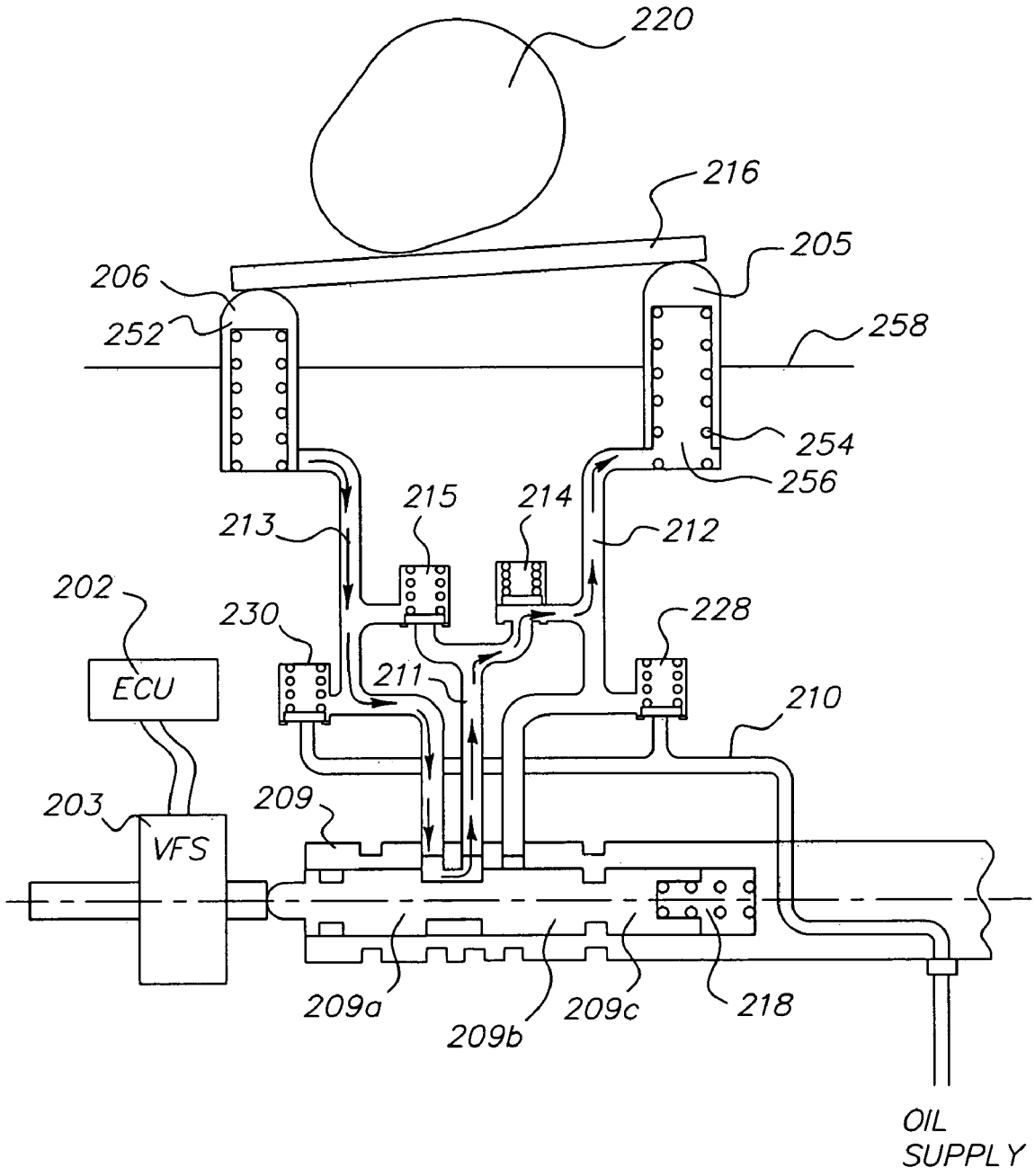
FIG. 9 shows a schematic of an alternate embodiment of the pivoting lifter system in the first position.
Figure 10:
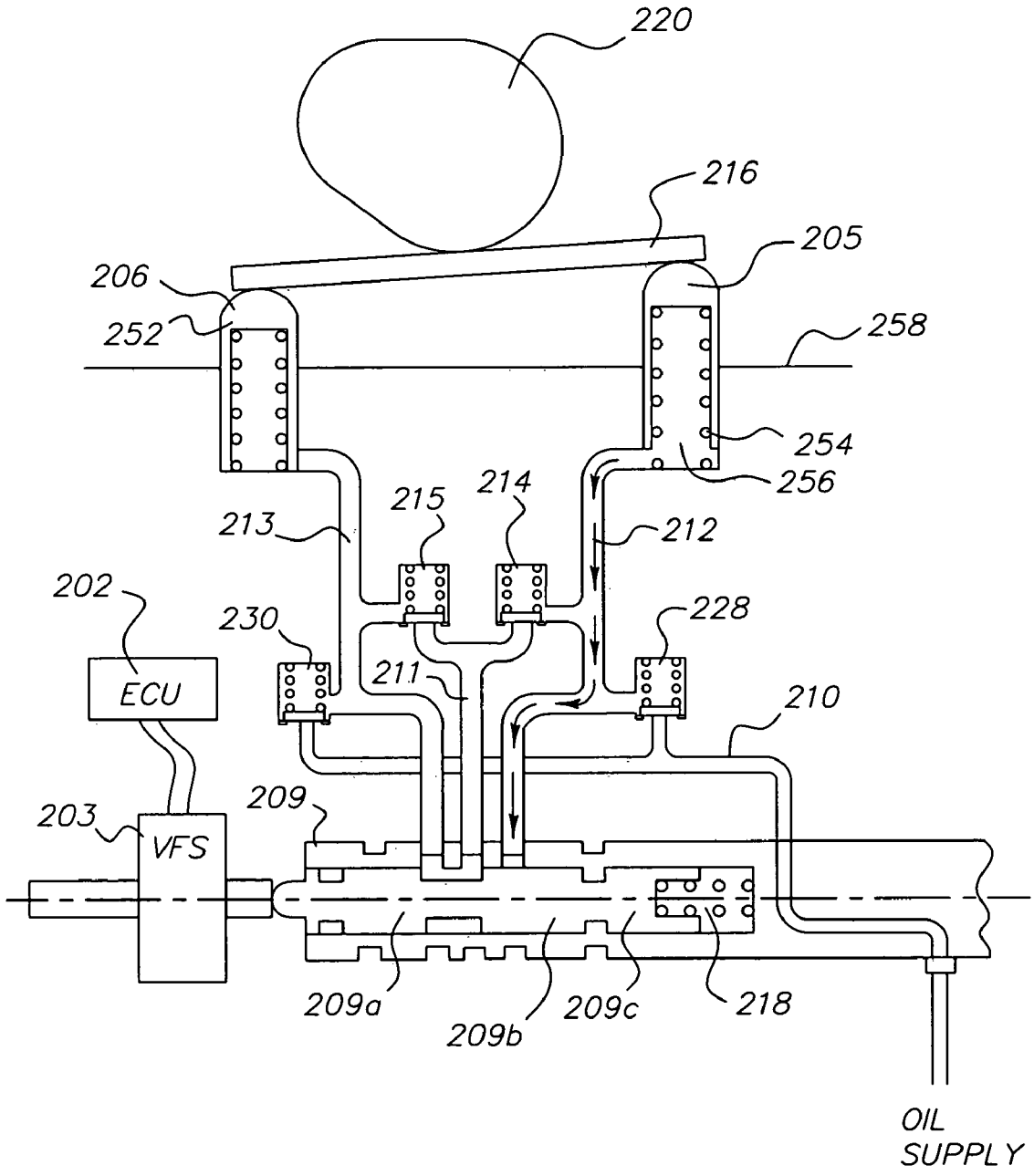
FIG. 10 shows a schematic of an alternate embodiment of the pivoting lifter system maintaining the first position.
Figure 11:
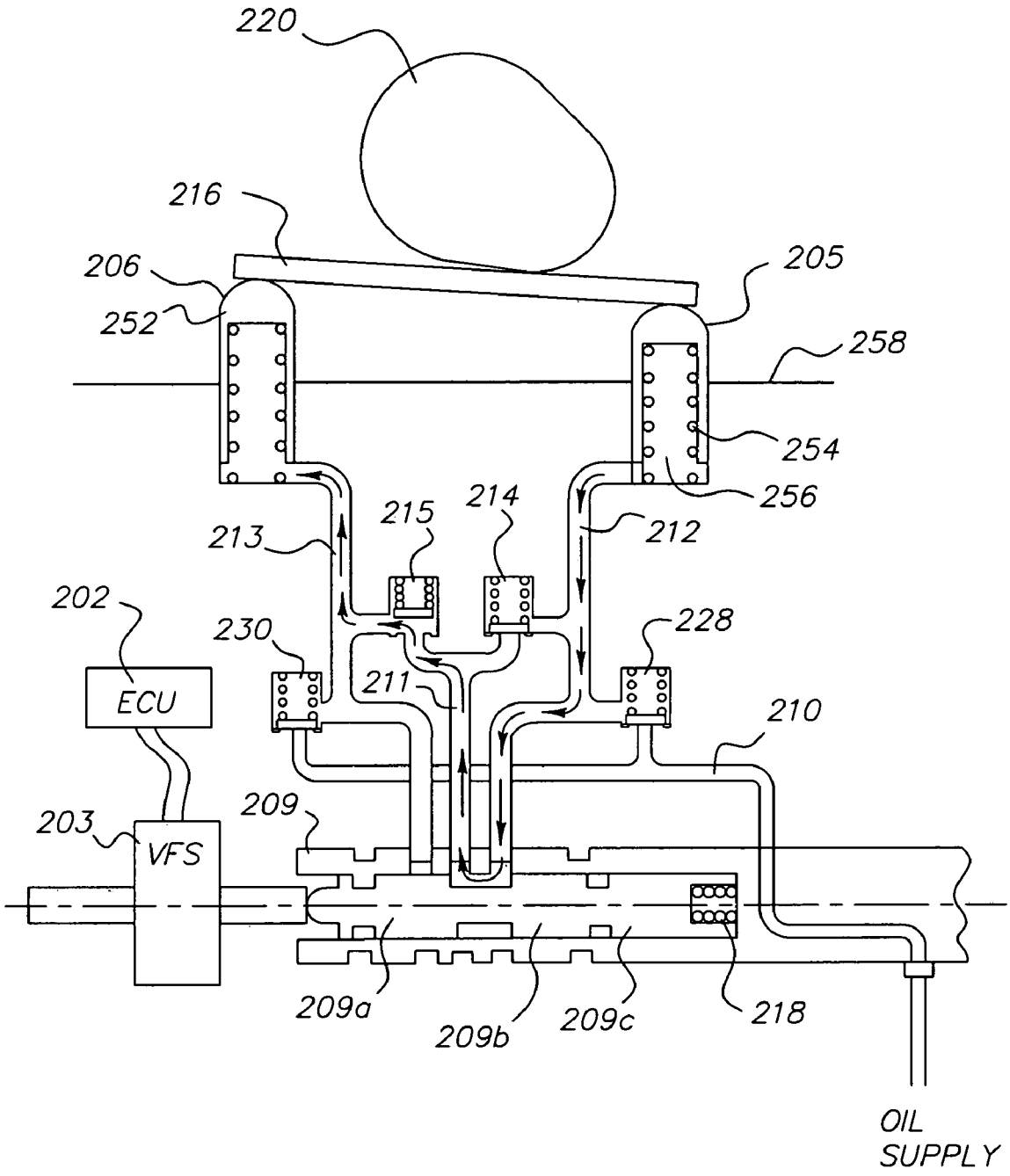
FIG. 11 shows a schematic of an alternate embodiment of the pivoting lifter system in the second position.
Figure 12:
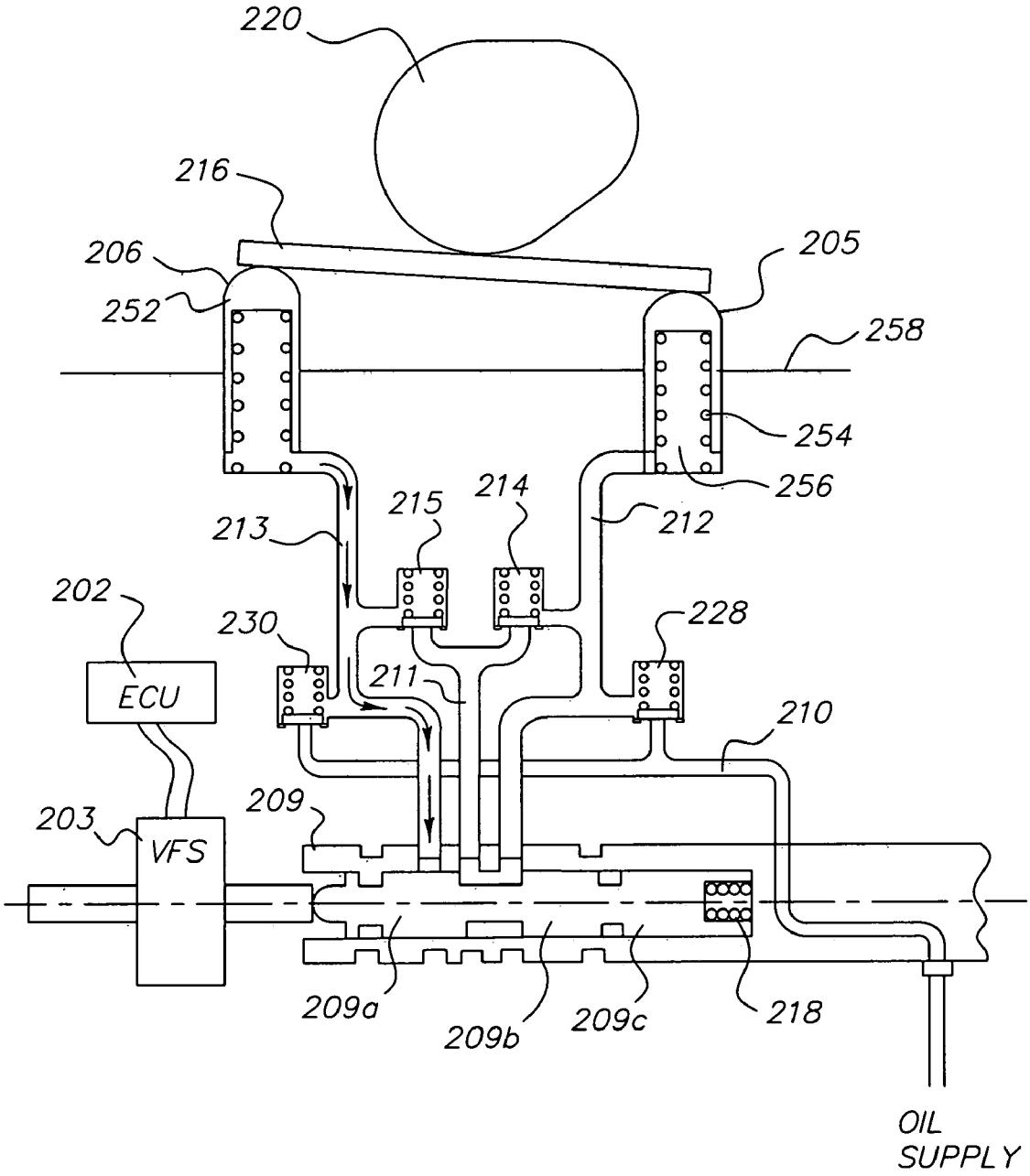
FIG. 12 shows a schematic of an alternate embodiment of the pivoting lifter system in maintaining the second position.

FIGS. 9 through 12 show the positions of the cam lobe 220 as it rotates and contacts the pivoting lifter plate or cam contacting plate 216 in a second embodiment. FIG. 9 shows the cam lobe 220 contacting and pressing down on the pivoting lifter plate 216. FIG. 10 shows the position of the cam lobe 220 after it has rotated counterclockwise and maintenance of the position of the pivoting lifter plate. FIG. 11 shows the cam lobe 220 just prior to the lobe rotating counterclockwise again after the spool position has changed. FIG. 12 shows the cam lobe 220 just after the lobe has rotated counterclockwise and maintenance of the position of the pivoting lifter plate.

FIG. 9 shows a schematic of the pivoting lifter of a second embodiment. Hydraulic fluid is supplied from a source to an inlet line 210 which passes through either check valve 228 or 230 to provide the hydraulic fluid when the system is initially started (not shown) or when additional fluid is needed by the system for makeup purposes. Check valves 228, 230 only allow fluid into lines 212, 213 respectively. Assuming that fluid is already present in the system, a control valve 209, is slidable back and forth and has three lands, 209*a*, 209*b*, 209*c*, each of which fit snuggly within a bore in the head. The control valve 209 is biased by a spring 218 on one side and variable force actuator 203, which may me a variable force solenoid, on the other. The variable force actuator 203 is controlled by the ECU 202. The position of the control valve 209, inwards or outwards determines the flow of oil to and from each of the hydraulic actuators 205, 206 adjacent to the pivoting lifter plate or cam contacting plate 216 in addition to the force exerted on the lifter 216. The hydraulic actuators 205, 206 comprise a hollow piston 252, a fluid chamber 256, and a spring 254, though the hydraulic actuators may also comprise a solid piston and a spring.

As shown in FIG. 9, the control valve is in an outward position. The cam lobe 220 is pressing down on the pivoting lifter plate 216, compressing spring 254, which causes hydraulic fluid in the hydraulic actuator 206 to exhaust to line 113. Hydraulic fluid from line 113 feeds through control valve 209 and into line 211 until mostly all the fluid is exhausted from hydraulic actuator 206. From line 211, fluid enters line 212 and fluid chamber 256 of hydraulic actuator 206 through check valve 214, overcoming the force of the spring 254 to raise the hollow piston on the right side, as shown in the Figure, and thus raising the right side of the pivoting lifter plate 216. Once most of the fluid has exhausted from hydraulic actuator 206 and cam lobe 220 begins to rotate, most of the hydraulic fluid has passed through line 211 and check valve 214 closes due to lack of pressure and fluid. Since land 209*b* blocks line 212 from recirculating fluid through the control valve 209 and check valves 214, 228, fluid in hydraulic actuator 205 remains in place as shown in FIG. 10, until control valve 209 moves again to a retard position.

The control valve 209 is moved inward by the variable force actuator 203, compressing spring 218 as the cam lobe 220 presses down on the pivoting lifter plate 216. The control valve 209 movement to the retard position and the cam lobe 220 pressure on the pivoting lifter plate 216 and the hydraulic actuator 205, causes the spring 254 to compress and fluid to exhaust from the fluid chamber 256 into line 212. From line 212 fluid enters the control valve 209 and line 211. The fluid and pressure causes check valve 215 to open, allowing fluid into line 213 which leads to hydraulic actuator 206. As the fluid fills chamber 256, spring 254 expands, pushing up on hollow piston 252 and pivoting lifter plate 216, raising the left side of the plate 216.

Once most of the fluid has exhausted from hydraulic actuator 205 and cam lobe 220 begins to rotate, most of the hydraulic fluid has passed through line 211 and check valve 215 closes due to lack of pressure and fluid. Since land 209*a* blocks line 213 from recirculating fluid through the control valve 209 and check valves 215, 230 blocks recirculation of fluid, fluid in the hydraulic actuator 206 remains in place as shown in FIG. 12, until control valve 209 moves again.

Figure 13:
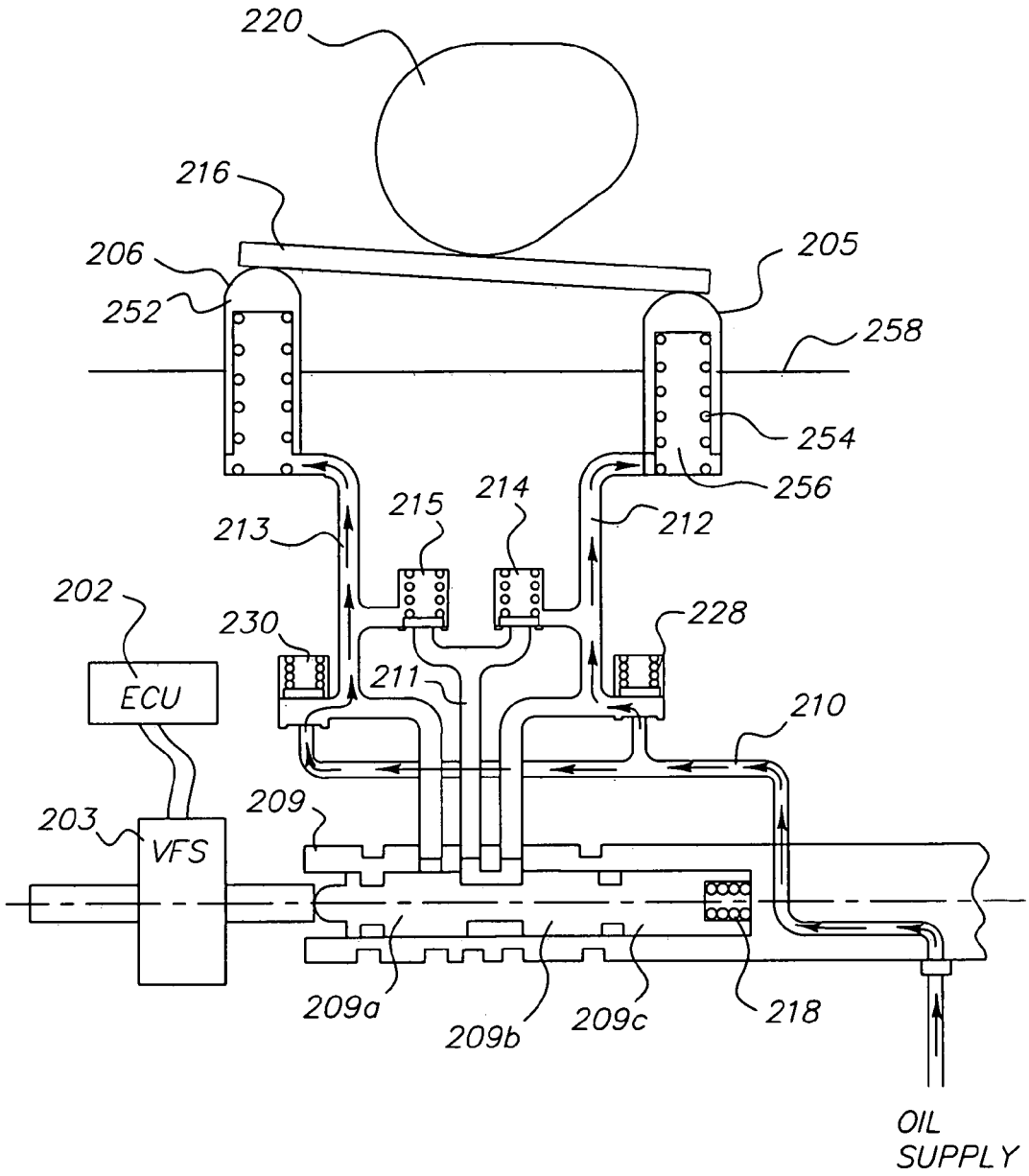
FIG. 13 shows a schematic of an alternate embodiment in which the make-up oil is supplied.

Makeup fluid is provided in the null position of the control valve 209, as shown in FIG. 13. Hydraulic fluid from inlet line 210 flows through check valves 228, 230 and into lines 212, 213. From lines 212, 213 fluid flows into hydraulic actuators 205, 206 respectively.

Figure 14:
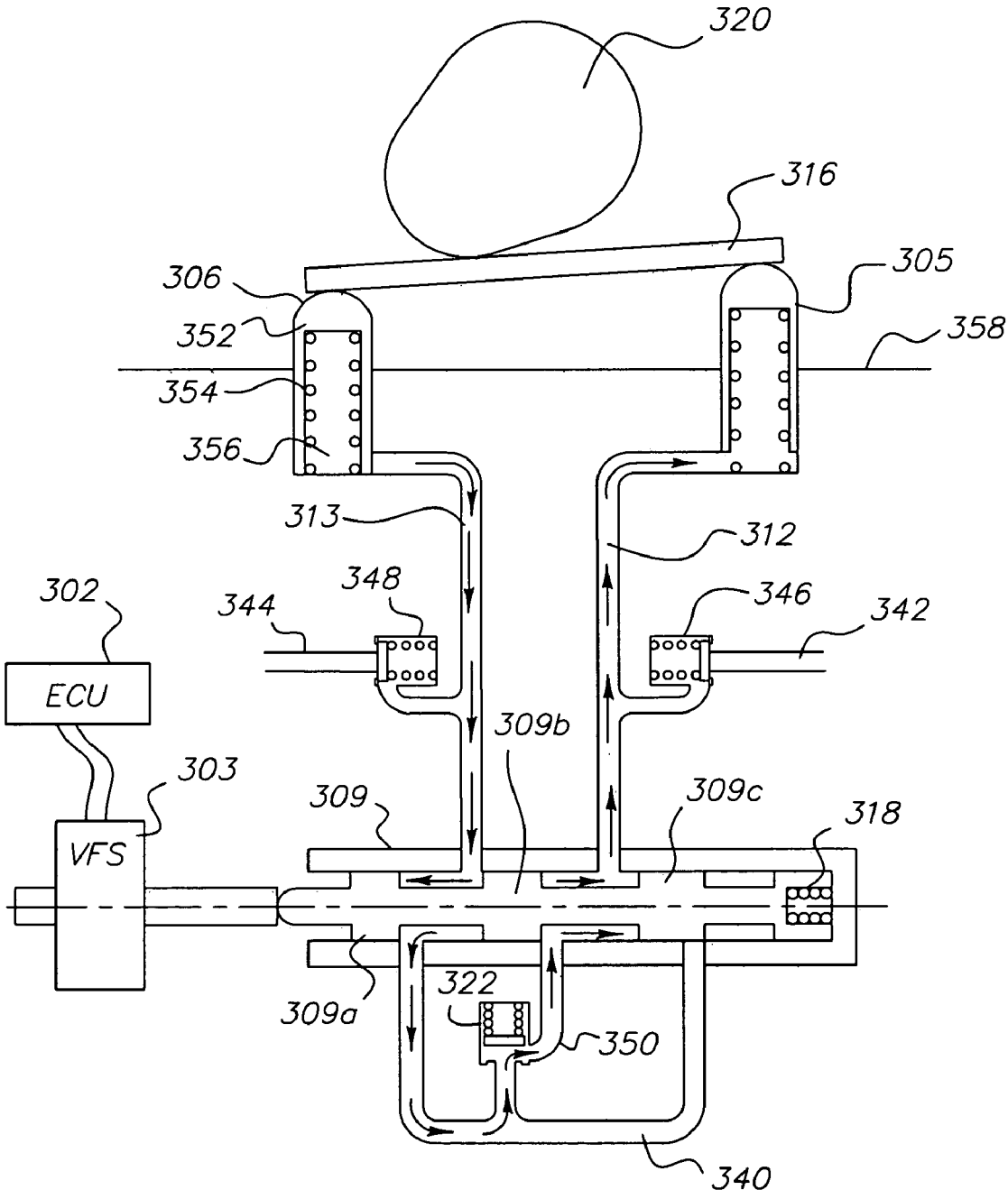
FIG. 14 a schematic of another embodiment of the pivoting lifter system in the first position.
Figure 15:
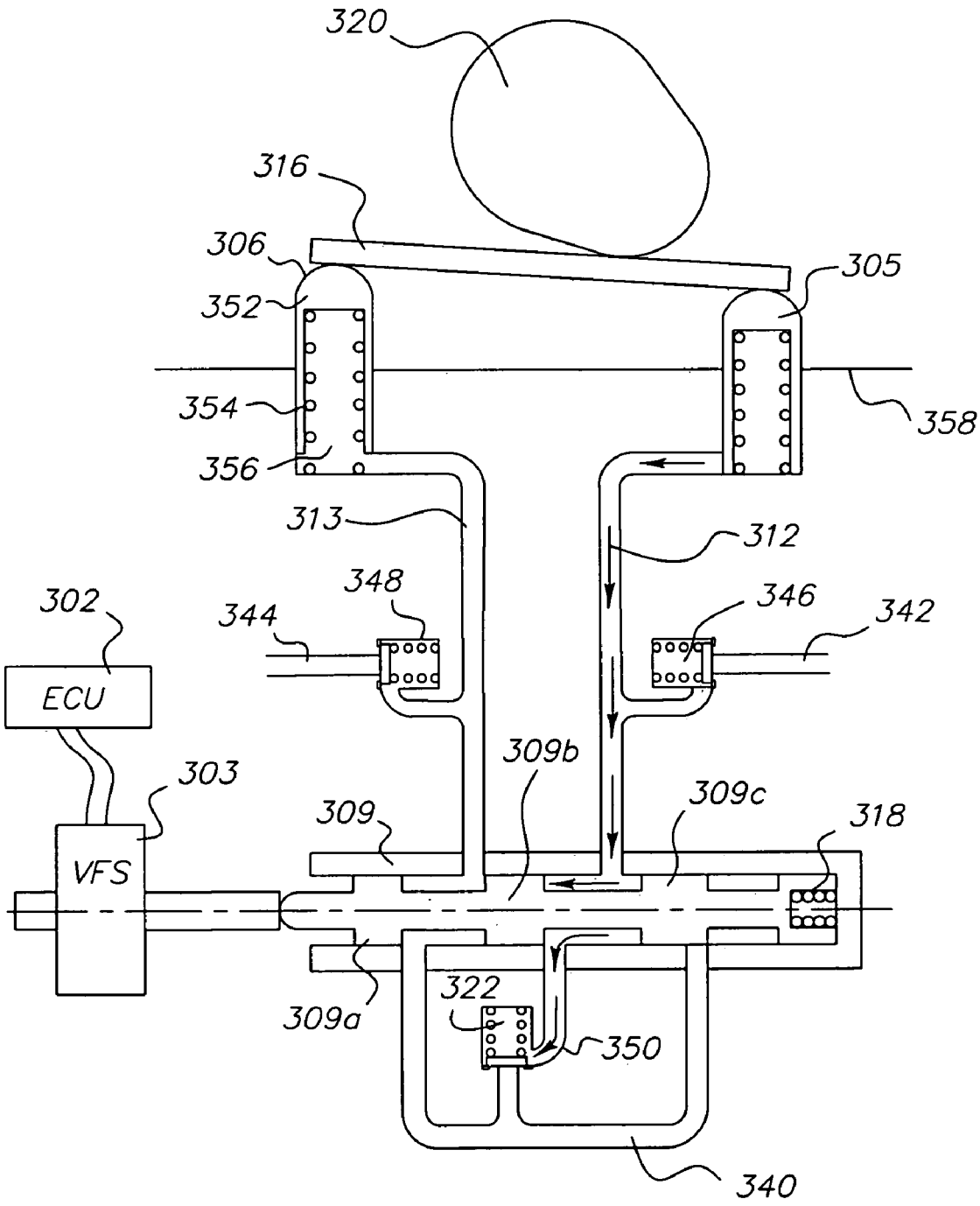
FIG. 15 shows a schematic of another embodiment of the pivoting lifter system maintaining the first position.
Figure 16:
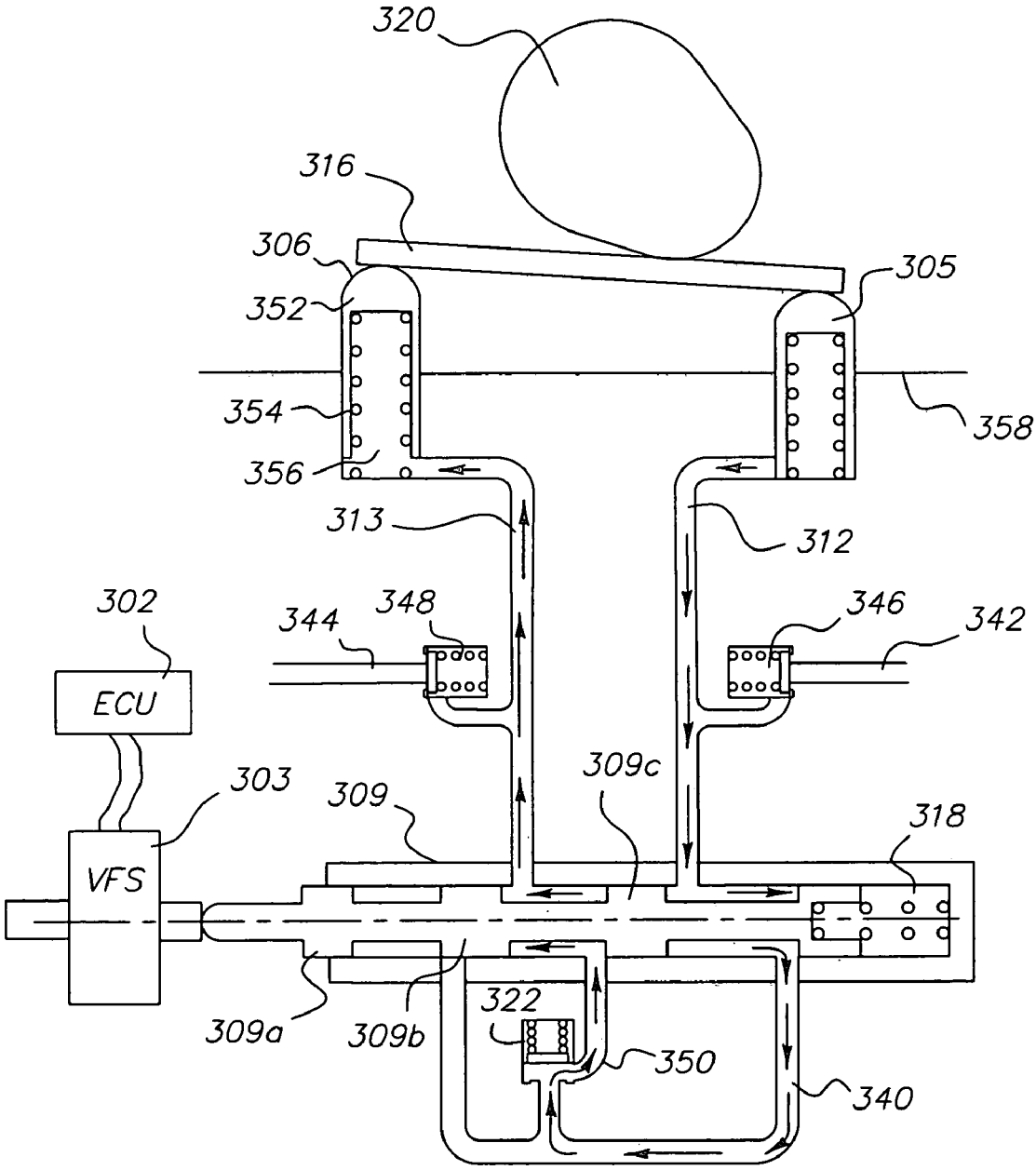
FIG. 16 shows a schematic of another embodiment of the pivoting lifter system in the second position.
Figure 17:
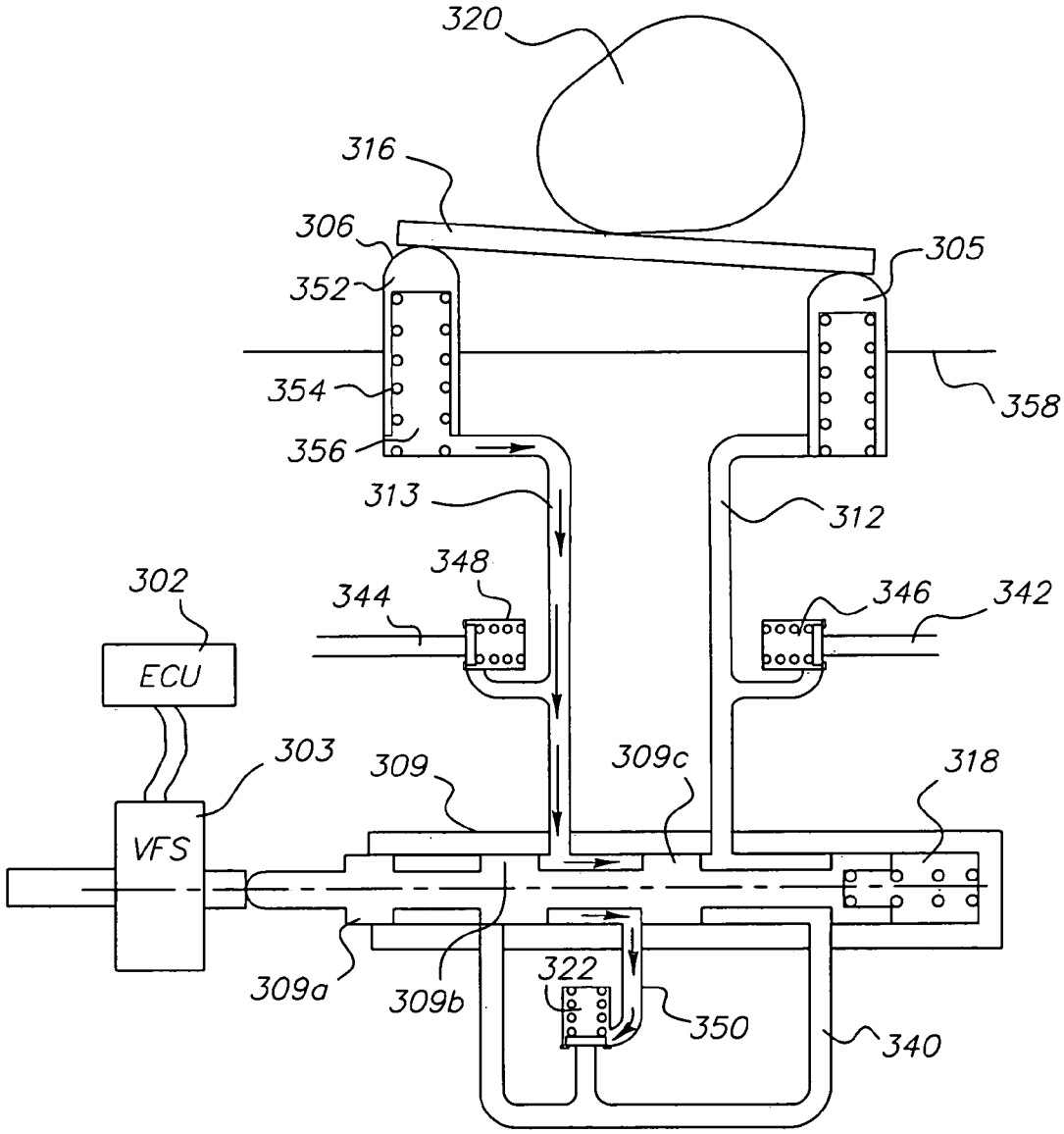
FIG. 17 shows a schematic of another embodiment of the pivoting lifter system in maintaining the second position.
Figure 18:
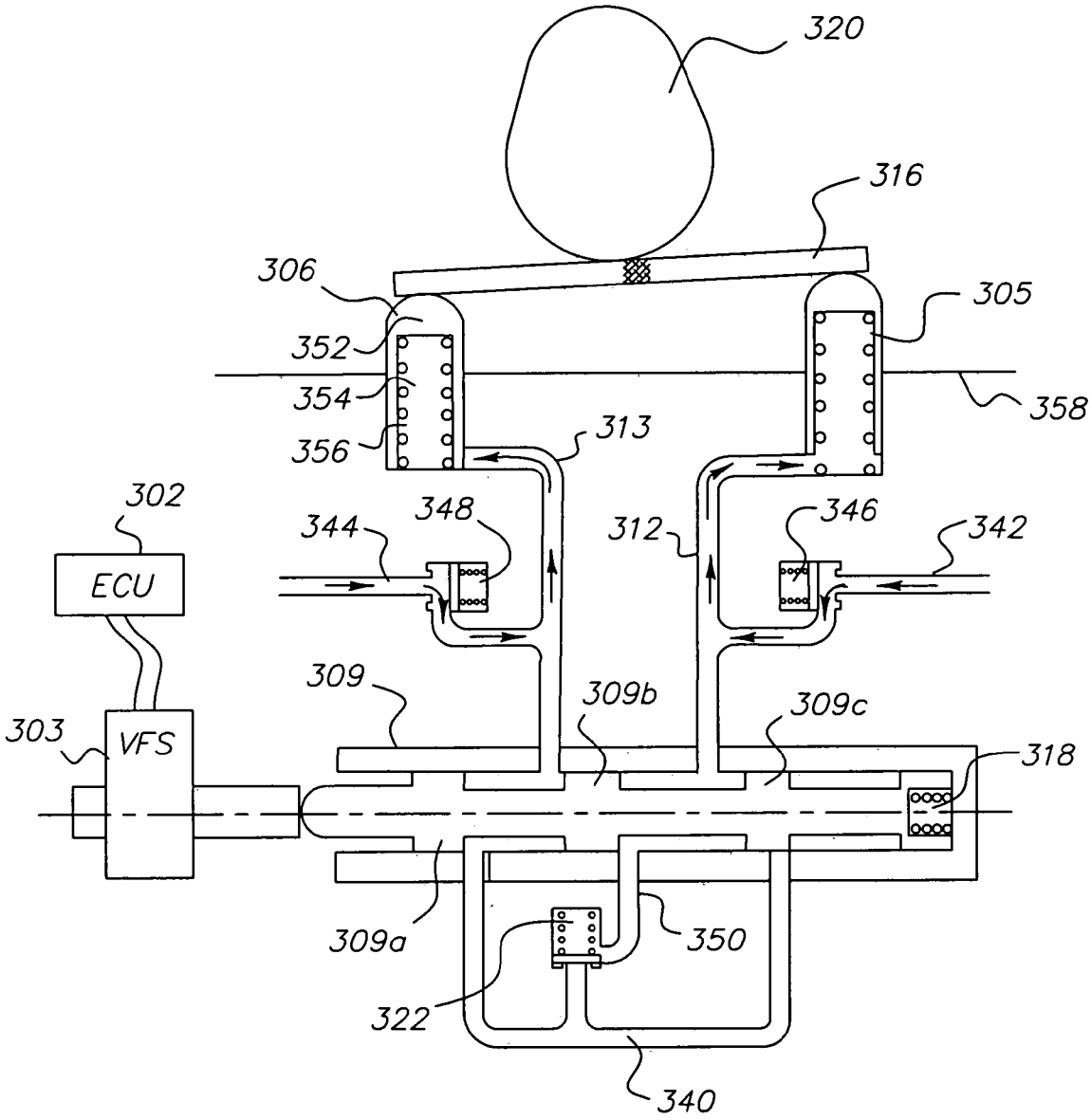
FIG. 18 shows a schematic of another embodiment in which the make-up oil is supplied.
Figure 21:
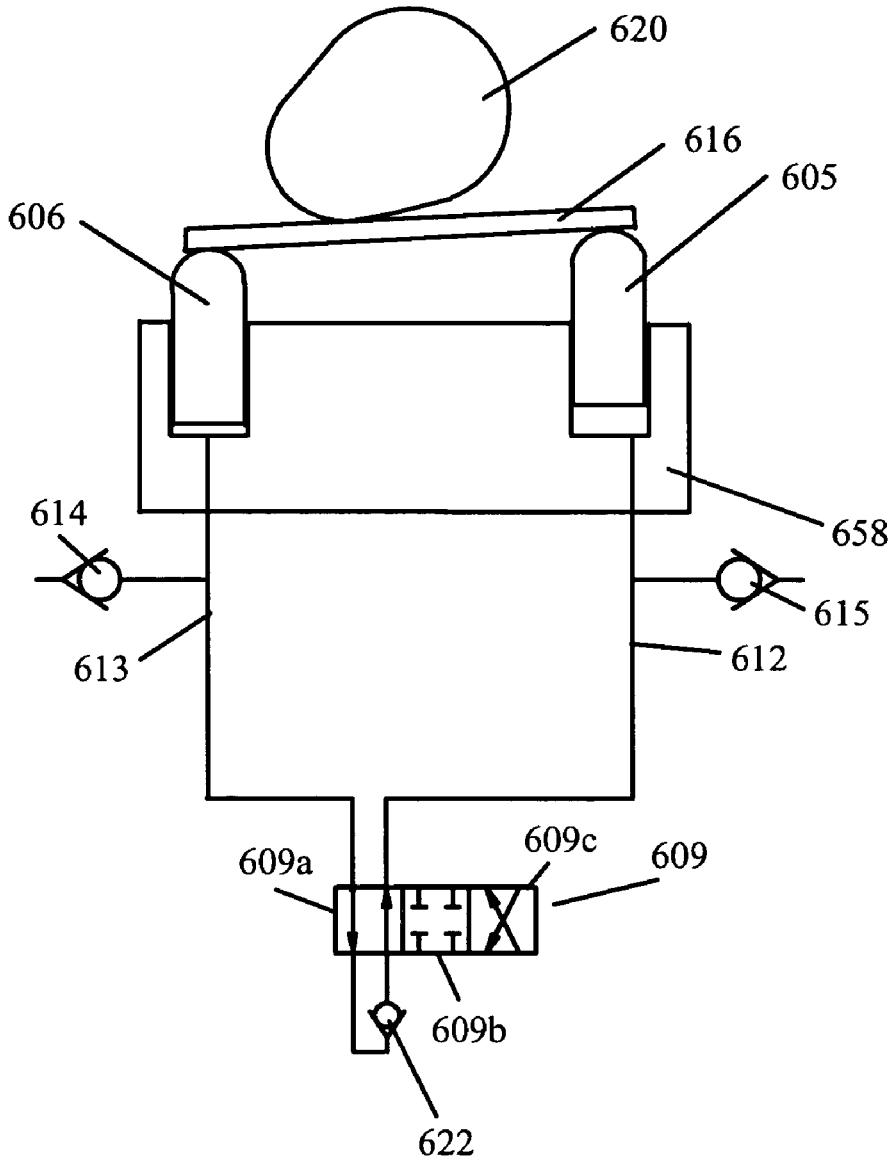
FIG. 21 shows a schematic of the control valve shown in FIGS. 14 through 18.

FIGS. 14 through 17 show the positions of the cam lobe as it rotates and contacts the pivoting lifter plate in a third embodiment. FIG. 14 shows the cam lobe 320 contacting and pressing down on the pivoting lifter plate 316. FIG. 15 shows the position of the cam lobe 320 after it has rotated counterclockwise and maintenance of the position of the pivoting lifter plate. FIG. 16 shows the cam lobe 320 just prior to the lobe rotating counterclockwise again after the spool position has changed. FIG. 17 shows the cam lobe 320 just after the lobe has rotated counterclockwise and maintenance of the pivoting lifter plate. FIG. 18 shows the cam lobe in the middle of rotation, when it is not applying any pressure on the pivoting lifter plate. FIG. 21 shows a schematic of the control valve in the third embodiment.

FIG. 14 shows a schematic of the pivoting lifter of a third embodiment. Hydraulic fluid is supplied from a source to inlet lines 342, 344, where the fluid passes through check valves 346, 348 respectively to provide hydraulic fluid when the system is initially started (not shown) or when additional fluid is needed by the system for makeup purposes. Check valves 346, 348 only allow fluid into lines 312, 313 respectively. Assuming that fluid is already present in the system, a control valve 309, is slidable back and forth and has three lands, 309*a*, 309*b*, 309*c*, each of which fit snuggly within the a bore in the head of the engine. The control valve 309 is biased by a spring 318 on one side and a variable force actuator 303 on the other, in this case a variable force solenoid. The variable force actuator 303 is controlled by the ECU 302. The position of the control valve 309, inwards or outwards determines the flow of oil to and from each of the hydraulic actuators 305, 306 adjacent to the pivoting lifter plate 316 in addition to the force exerted on the lifter 316. The hydraulic actuators 305, 306 comprise a hollow piston 352, a fluid chamber 356, and a spring 354.

As shown in FIG. 14, the control valve 309 is in an inward position. The cam lobe 320 is pressing down on the pivoting lifter plate 316, compressing spring 354, which causes hydraulic fluid in the hydraulic actuator 306 to exhaust to line 313. Hydraulic fluid from line 313 feeds through control valve 309 and into line 340. Since control valve land 309*c* blocks entry back into the control valve from line 340, fluid enters line 350 through check valve 322 and into the control valve 309 to line 312 between lands 309*b* and 309*c*. Fluid in line 312 enters fluid chamber 356 of hydraulic actuator 305, overcoming the force of spring 354 to raise the hollow piston 352 on the right side, as shown in FIG. 14, and thus raising the right side of the pivoting lifter plate 316.

FIG. 15 shows the position of the cam lobe 320 after it has rotated counterclockwise. Fluid from the hydraulic actuator 305 exhausts into line 312 to the control valve 309. From the control valve 309, the fluid enters line 350 and is blocked by check valve 322. Fluid is also blocked from entering line 342 by check valve 346. Since the fluid is prevented from exiting the hydraulic actuator 305 and line 312 to line 340, the position of the pivoting lifter plate 316 is maintained.

FIG. 16 shows the spool in the outward position. In this position, the cam love 20 presses down on the pivoting lifter plate 316, compressing spring 354, which causes 5 hydraulic fluid in the hydraulic actuator 305 to exhaust to line 312. Hydraulic fluid from line 312 feeds through control valve 309 and into line 340. Since control valve land 309*b* blocks entry back into the control valve from line 340, fluid enters line 350 through check valve 322 and into control valve 309 to line 313 between lands 309*b* and 309*c*. Fluid in line 313 enters fluid chamber 356 of hydraulic actuator 306, overcoming the force of spring 354 to raise the hollow piston 352 on the left side, as shown in FIG. 16, and thus raising the left side of the pivoting lifter plate 316.

FIG. 17 shows the position of the cam lobe 320 after it has rotated counterclockwise again. Fluid from the hydraulic actuator 306 exhausts into line 313 to the control valve 309. From the control valve 309, the fluid enters line 350 and is blocked by check valve 322. Fluid is also blocked from entering line 344 by check valve 348. Since the fluid is prevented from exiting the hydraulic actuator 306 and line 313 to line 340, the position of the pivoting lifter plate 316 is maintained.

Makeup fluid is supplied to the system as shown in FIG. 18. Makeup fluid enters through lines 342, 344 through check valves 346, 348 respectively from an oil supply (not shown) when the cam lobe 320 is in the middle of rotation and the cam lobe is not applying any pressure on the pivoting lifter plate 316.

Figure 19:
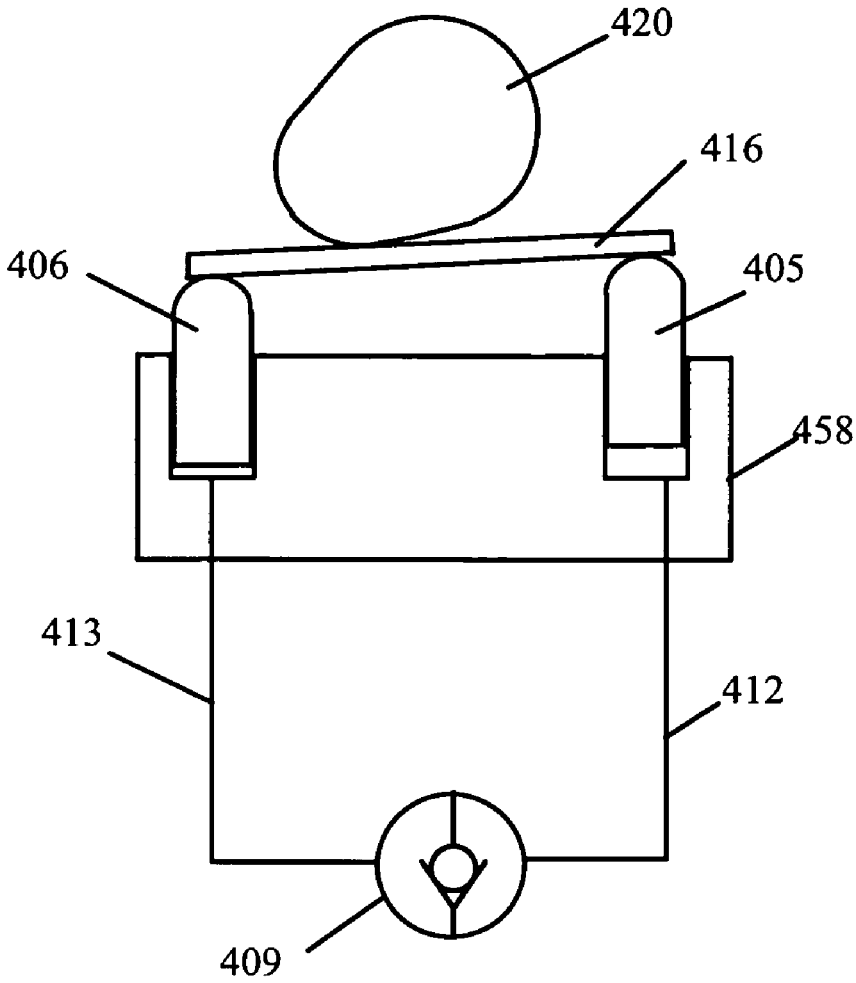
FIG. 19 shows a schematic of an alternative control valve.
Figure 20:
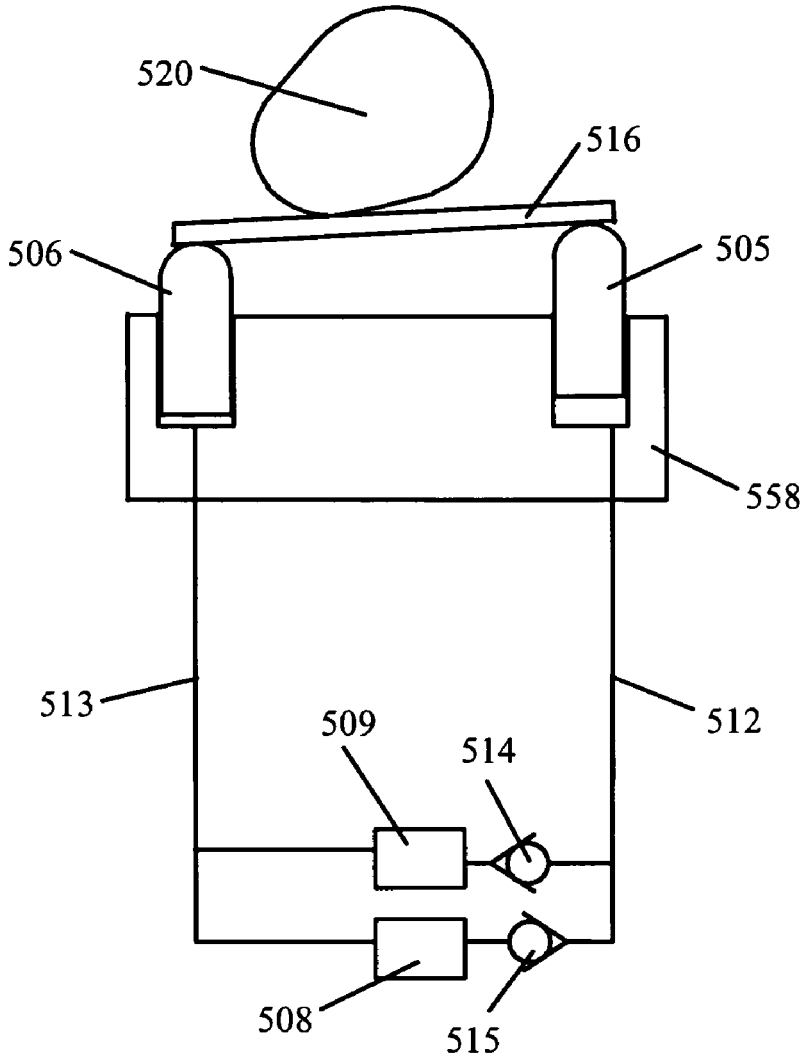
FIG. 20 shows a schematic of another alternative control valve.

FIGS. 19 through 21 shows alternative control valves that may be used in the pivoting lifter system. A supply line (not shown) is necessary to supply makeup fluid for each of the systems show in the figures. FIG. 19 shows control valve 409, in this case a rotatable one way valve containing a check valve. Lines 412, 413 are connected to chambers in the lifter body 458 containing hydraulic actuators 405, 406 and enter either side of control valve 409. Depending on how the control valve 409 is rotated, fluid may only go from one hydraulic actuator to another or remain in the hydraulic actuator 405, 406. Cam contacting plate or pivoting lifter plate 416 rotates about an axis depending on the positions of the hydraulic actuators 405, 406 and cam lobe 420.

FIG. 20 shows another alternate control valve. In this case, the control valve comprises two separate solenoids 508, 509. Each solenoid may be turned on or off and has a line 513 which enters the solenoids 508, 509 on one side and a line 512 leaving the solenoids 509, 508 with check valves 514, 515 on the other side. Lines 512, 513 are also connected to the chambers in the lifter body 558 containing the hydraulic actuators 505. 506. Fluid from line 512 may enter control valve 508 though check valve 515 and to line 513 which leads to hydraulic actuator 506. Fluid from line 513 may enter control valve 509 through check valve 514 to enter line 512 and hydraulic actuator 505. Cam contacting plate or pivoting lifter plate 516 rotates about an axis depending on the positions of the hydraulic actuators 505, 506 and cam lobe 520.

FIG. 21 shows the control valve present in the third embodiment shown in FIGS. 14 through 18. Lines 613 and 612 lead from hydraulic actuators 606, 605 respectively, to control valve 609. Off of lines 612, 613 are check valves 614, 615 for providing makeup fluid to the system. Control valve 609 is comprised of three ports, port 609*a*, 609*b*, and 609*c*. Port 609*a* allows fluid to move from hydraulic actuator 606 through line 613, through control valve 609 and check valve 622 and back through the control valve 609 to line 612 and hydraulic actuator 605. Port 609*b* maintains the positions of the hydraulic actuators 605, 606 and the pivoting lifter plate 616. Port 609*c* allows fluid to move from hydraulic actuator 605 through line 612, through control valve 609 and check valve 622 and back through the control valve to line 613 and hydraulic actuator 613.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. An internal combustion engine having a camshaft having a plurality of cam lobes, a plurality of valves, each of the valves being actuated by a lifter actuated by the camshaft with a cam lobe, the lifter comprising a lifter body having an upper surface and a lower surface;

a cam contact plate pivoting on an axis on the upper surface of the lifter body;

opposed hydraulic actuators on either side of the axis of the cam contact plate, each hydraulic actuator comprising a fluid chamber in the lifter body, a piston in the chamber, and a spring biasing the piston into contact with the cam contact plate;

a line supplying hydraulic fluid to the fluid chambers of the hydraulic actuators;

a control valve for controlling fluid flow from one hydraulic actuator to the other hydraulic actuator.

2. The internal combustion engine of claim 1, wherein the control valve comprises separate solenoid valves.

3. The internal combustion engine of claim 1, wherein the control valve comprises a rotatable one-way valve.

4. The internal combustion engine of claim 1, wherein the control valve comprises a spool having a plurality of lands slidably mounted within a bore.

5. The internal combustion engine of claim 1, wherein the piston of the hydraulic actuators may be solid or hollow.

6. The internal combustion engine of claim 1, further comprising an inlet line for supplying makeup fluid to the line supplying hydraulic fluid to the fluid chambers of the hydraulic actuators.

7. The internal combustion engine of claim 6, wherein the inlet line further comprises a check valve.

8. The internal combustion engine of claim 1, wherein the line supplying hydraulic fluid to the fluid chambers of the hydraulic actuators further comprises a check valve.

* * * * *

UNITED STATES PATENT AND TRADEMARK OFFICE

CERTIFICATE OF CORRECTION

PATENT NO. : 6,990,935 B2
DATED : January 31, 2006
INVENTOR(S) : Roger T. Simpson It is certified that error appears in the above-identified patent and that said Letters Patent is hereby corrected as shown below:

Title page,
Item [54], Title, should read -- PIVOTING LIFTER CONTROL SYSTEM USING CONTROL VALVE TO RECIRCULATE FLUID --.

Signed and Sealed this

Eleventh Day of April, 2006

JON W. DUDAS
*Director of the United States Patent and Trademark Office*

UNITED STATES PATENT AND TRADEMARK OFFICE

CERTIFICATE OF CORRECTION

PATENT NO. : 6,990,935 B2
APPLICATION NO. : 10/968451
DATED : January 31, 2006
INVENTOR(S) : Roger T. Simpson It is certified that error appears in the above-identified patent and that said Letters Patent is hereby corrected as shown below:

Please insert,
Page 1, line 1

Item (54) Title: PIVOTING LIFTER CONTROL SYSTEM USING CONTROL VALVE TO RECIRCULATE FLUID Signed and Sealed this Twelfth Day of December, 2006

JON W. DUDAS
*Director of the United States Patent and Trademark Office*